US008839479B2

(12) United States Patent
Hruby

(10) Patent No.: US 8,839,479 B2
(45) Date of Patent: Sep. 23, 2014

(54) ORBITAL SURFACE CLEANING APPARATUS

(76) Inventor: Jeffrey T. Hruby, Vista, CA (US)

( * ) Notice: Subject to any disclaimer, the term of this patent is extended or adjusted under 35 U.S.C. 154(b) by 3 days.

(21) Appl. No.: 13/515,176

(22) PCT Filed: Dec. 17, 2009

(86) PCT No.: PCT/US2009/068467

§ 371 (c)(1),
(2), (4) Date: Oct. 15, 2012

(87) PCT Pub. No.: WO2011/071506

PCT Pub. Date: Jun. 16, 2011

(65) Prior Publication Data

US 2013/0042424 A1 Feb. 21, 2013

(51) Int. Cl.

| | |
|---|---|
| ***A47L 11/14*** | (2006.01) |
| ***A47L 11/282*** | (2006.01) |
| ***A47L 11/40*** | (2006.01) |
| ***A47L 11/162*** | (2006.01) |

(52) U.S. Cl.

CPC ..... *A47L 11/1625* (2013.01); *A47L 11/4069* (2013.01); *A47L 11/4075* (2013.01); *A47L 11/4038* (2013.01); *A47L 11/4055* (2013.01)

USPC ..... 15/98; 15/49.1; 15/50.1; 451/350; 451/353; 451/357

(58) Field of Classification Search

USPC ..... 15/49.1, 50.1, 98; 451/350, 353, 357, 451/359

See application file for complete search history.

(56) References Cited

U.S. PATENT DOCUMENTS

| | | | | | |
|---|---|---|---|---|---|
| 1,554,622 | A | * | 9/1925 | Chancellor | 15/50.1 |
| 2,967,315 | A | * | 1/1961 | Helbig et al. | 15/49.1 |
| 3,094,152 | A | * | 6/1963 | Kenny et al. | 141/19 |
| 3,203,707 | A | * | 8/1965 | Anderson | 280/655.1 |
| 3,204,272 | A | * | 9/1965 | Greene et al. | 15/49.1 |
| 3,348,254 | A | * | 10/1967 | Storm, Jr. et al. | 15/49.1 |
| 3,366,288 | A | * | 1/1968 | Goldschein | 222/504 |
| 3,550,324 | A | * | 12/1970 | Gerry | 451/259 |
| 3,795,932 | A | * | 3/1974 | Young | 15/98 |
| 4,791,694 | A | * | 12/1988 | Itaya et al. | 15/97.1 |
| 5,203,046 | A | * | 4/1993 | Shaw | 15/98 |
| 5,253,384 | A | * | 10/1993 | Joines et al. | 15/98 |
| 5,355,542 | A | * | 10/1994 | Oreck et al. | 15/49.1 |
| 6,616,517 | B2 | * | 9/2003 | Palushi | 451/350 |
| 6,938,295 | B1 | * | 9/2005 | Lancaster et al. | 15/49.1 |
| 7,033,258 | B2 | * | 4/2006 | Jordan | 451/350 |
| 7,563,156 | B2 | * | 7/2009 | Anderson | 451/353 |

FOREIGN PATENT DOCUMENTS

| | | | |
|---|---|---|---|
| JP | 2000-41926 | * | 2/2000 |
| WO | 93/18700 | * | 9/1993 |
| WO | 99/01062 | * | 1/1999 |

* cited by examiner

*Primary Examiner* — Mark Spisich
(74) *Attorney, Agent, or Firm* — Donn K. Harms

(57) ABSTRACT

Orbital surface cleaning apparatus (400) are presented. An orbital surface cleaning apparatus (400) can include a driver motor (410) coupled to a plate (130) having offset distributed weights (133). As the plate (130) rotates, the offset weights (133) cause oscillations of the apparatus (400) cleaning head. A driver motor (410) capable of 80 RPM can induce over 1700 RPM oscillations.

20 Claims, 8 Drawing Sheets

ORBITAL SURFACE CLEANING APPARATUS

This application claims the benefit of priority to U.S. provisional application having Ser. No. 61/285,930 filed on Dec. 11, 2009. This and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

FIELD OF THE INVENTION

The field of the invention is orbital surface cleaning technologies.

BACKGROUND

Floor cleaning apparatus are heavy, bulky, and cumbersome to operate. Orbital floor cleaning apparatus exacerbates the negative aspects of floor cleaning apparatus due to offset weights used to achieve orbital motion. The weights are used to achieve desirable cleaning oscillations. Unfortunately, such apparatus are made to be heavy to counterbalance motions of the weights. The result is a difficult to use apparatus that provides an uncomfortable experience for the user. For example, U.S. Pat. No. 5,355,542 to Oreck et al. titled "Orbiter Floor Apparatus", granted Oct. 18, 1994, describes a floor cleaning apparatus that is bulky and difficult to use.

One issue with the Oreck approach is that is requires many off center moving parts are required to achieve desired orbital motion at the expense of user comfort. Such approaches are considered disadvantageous because the parts create numerous stresses during use. A more ideal orbital floor cleaning system would utilize fewer parts with higher precision to generating desirable motion, while also balancing user comfort.

What has yet to be appreciated is floor cleaning apparatus can be produced to have modular parts to allow users to quickly adapt an apparatus for a particular purpose. Such an apparatus can include an orbital drive assembly configured with few parts, thus eliminating costly maintenance or downtime. Furthermore, the modularity of an apparatus allows non-technical users to quickly replace parts, to upgrade the apparatus, or otherwise configure the apparatus for a target application. A modular apparatus allow for easily breaking the apparatus down and transporting it to new locations. Such an approach can be advantageously employed while maintaining a comfortable experience for the user.

Thus, there is still a need for orbital cleaning apparatus.

SUMMARY OF THE INVENTION

The present invention provides apparatus, systems and methods where an orbital floor cleaning apparatus can include a folding handle assembly and an orbital drive assembly. In one aspect of the inventive subject matter an orbital floor cleaning apparatus can include an orbital drive motor disposed on a top surface of a driver base, and handle assembly coupled to the driver base. Preferred orbital driver assemblies comprise a driver motor, a driver plate, a bearing assembly, and a pad driver. The motor couples through the driver base to the driver plate via a drive shaft. Preferred driver plates include one or more offset weights to provide an oscillation motion as the motor causes the driver and driver plate to rotate. A bearing assembly can be disposed between the driver plate and the driver to allow for smooth oscillating motion.

Contemplated handle assemblies can include one or more advantageous features. For example, the handle assembly can comprise one or more hinge connectors that allow the handle to fold back on itself, possibly through an approximately 180 degree angle, to reduce the overall size of the apparatus. Additionally, the handle assembly can include vertical grips, which can include one or more actuators used to control the apparatus.

In other aspects of the inventive subject, contemplated orbital floor cleaning apparatus can comprise one or more field replaceable parts. For example, the following parts can be replaced by non-technical individuals: driver plates, pads, driver motors, bottle cartridges, spray assemblies, or other parts. Modularity of flooring cleaning apparatus allows for ease of maintenance or ease of transport.

Various objects, features, aspects and advantages of the inventive subject matter will become more apparent from the following detailed description of preferred embodiments, along with the accompanying drawings in which like numerals represent like components.

DETAILED DESCRIPTION

The following discussion provides an overview of a modular orbital floor cleaning apparatus. Various elements or parts of the disclosed apparatus can be configured to be field-replaceable thus allowing for modification of the apparatus by an unskilled user. Parts of the system can be easily removed through one or more mechanical connectors, possibly comprising wing nuts, hook-and-loop fasteners (e.g., Velcro™), or other mechanical connectors. One should note that the various elements are considered to be field replaceable even if the following disclosure lacks such assertions.

Figure 1:
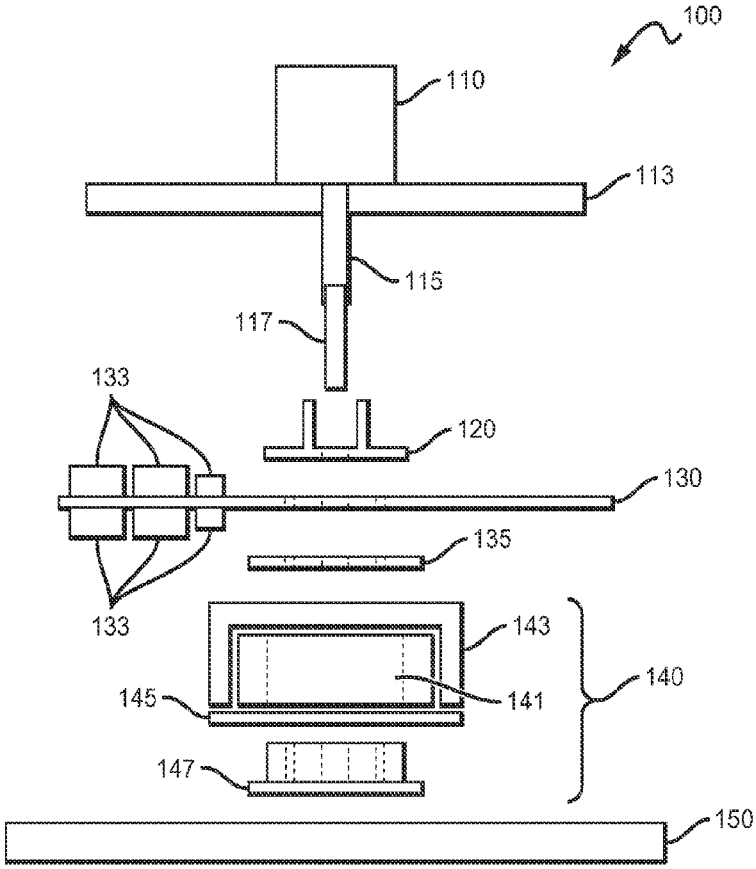
FIG. 1 is an exploded view of a possible orbital drive assembly.

One aspect of the inventive subject matter includes an orbital drive assembly. In FIG. 1, orbital drive assembly 100 comprises multiple generally circular parts disposed along a centerline defined by the axis of drive shaft 115.

Motor 110 can be disposed on an upper surface of an orbital base 113. In some embodiments, motor 110 can be mechanically mounted to orbital base 113 or to a handle assembly mounted to orbital base 113. Preferably, motor 110 includes drive shaft 115 that extends through orbital base 113 to the various parts disposed on the underside of base 113.

Drive shaft 115 can include a hollow, threaded interior configured to receive a pin or set screw 117. Set screw 117 can be used to mechanically couple driver 150 to motor 110. Drive shaft 115 can be inserted through the holes in the various parts to reach driver 150. The drive shaft holes are represented by dashed lines in the center of the parts.

Shaft support 120 can be configured to shroud and reinforce drive shaft 115 against stresses resulting from vibration of the orbital assembly 100 during use.

Driver plate 130 can be disposed under shaft support 120 as shown. Preferably plate 130 comprises one or more of weights 133 distributed asymmetrically around plate 130. Having displaced weights 133 provides for an oscillatory motion of a cleaning pad mounted on driver 150 (see FIG. 3). In some embodiments plate 130 allows a user to adjust positions of weights 133, possibly via one or more holes or slots disposed about plate 130.

Beneath plate 130, one or more of washer 135 can be used to provide space between plate 130 and bearing assembly 140.

Bearing assembly 140 is also illustrated as being symmetric for clarity about drive shaft 115. In a preferred embodiment, bearing assembly 140 has an offset shaft hole. The offset shaft hole coupled with the movement of weights 133 to allow driver 150 to rotate as well as oscillate about a common center.

Bearing assembly 140 preferably comprises bearing housing 143 in which is disposed bearing 141. Bearing center 147 inserts into the center of bearing 141 and can include a shaft hole, through which drive shaft 115 fits. Bearing center 147 can be held within housing 143 and within bearing 141 using retaining ring 145, where retaining ring 145 can be mechanically coupled to housing 143.

Driver 150 represents a plate or disk coupled to drive shaft 115. Cleaning pads can be attached to the underside of driver 150. Motor 110 causes driver 150 to rotate and oscillate via rotation of drive shaft 115. Shaft 115 is typically about ⅝ inches (about 1.59 centimeters) in diameter. Driver 150 can couple to shaft 115 via pin or set screw 117. Set screw 117 can have a diameter of ⅜ inches (about 0.95 centimeters) and can screw into a threaded receiving cavity of shaft 115.

Figure 2:
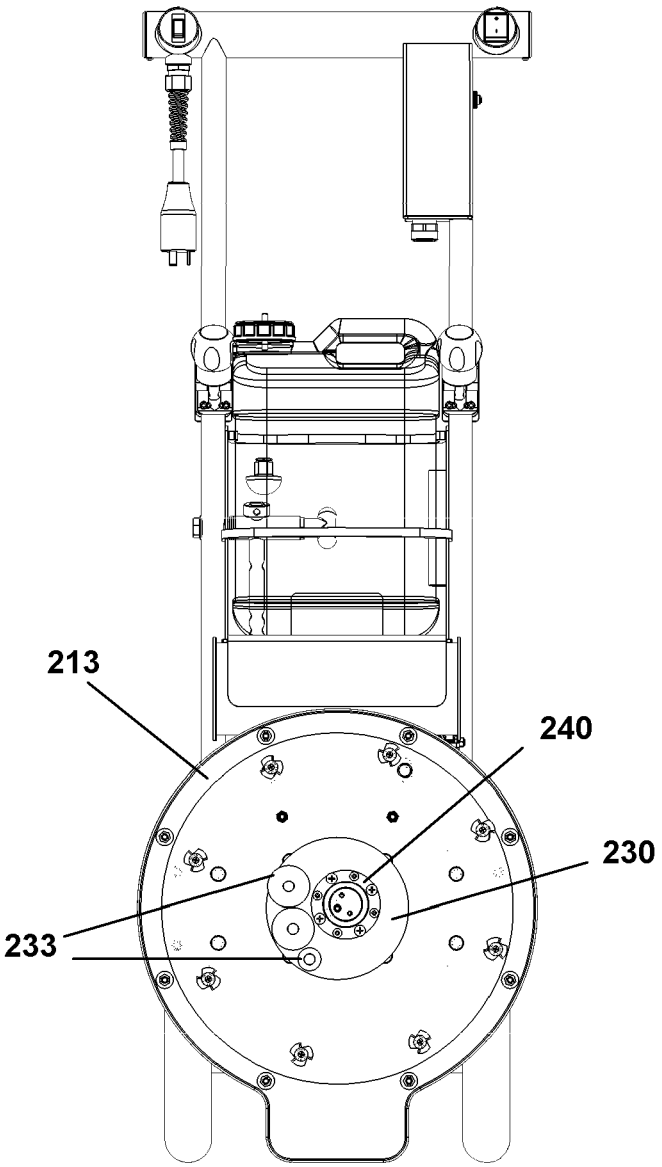
FIG. 2 illustrates an actual embodiment of an apparatus having a driver base, a driver plate, offset weights, and a bearing assembly.

FIG. 2 illustrates an actual embodiment of various aspects of a contemplated orbital drive assembly having parts disposed under driver base 213. The illustrated embodiment represents a Hruby Orbital Systems™ Orbot™. One should note that weights 233 are offset and distributed asymmetrically about plate 230. One should also note that bearing assembly 240 is disposed offset from the shaft hole.

The orbital/oscillating motion is preferably generated by the various precision machined parts shown in FIGS. 1 and 2. A driver (e.g., a driver 150) is mounted to an offset free spinning bearing assembly 240 that is mounted to the counter weight plate 230 having mounted weights 233. The orbital/oscillating drive motion is generated as counter weight plate 230 spins around bearing assembly 240. As the motor drives counter weight plate 230 the driver then begins to spin in one direction (e.g., at roughly 80 rpm) and at the same time the driver also oscillates/orbits around the central shaft point. Together with these two motions drive the orbital/oscillating drive motion (see FIG. 3).

The parts shown in FIGS. 1 and 2 play important roles in generating the orbital/oscillating motion, so do the characteristics involved in the design, shape, size, and weight of the various parts. For example, characteristics can include weight of the pad drivers, hook-and-loop pad fastener plate, cleaning pads (e.g., SuperZorb™ Pad, Agiclean™ Pad, etc.), glider system, the motor design, Orbot™ machine design (e.g., mounting and pin point of the wheels, axle, position of the rod locking lever, pull latch etc.), position where the bottle cartridge system is mounted on the handle assembly (e.g., weight distribution), or Orbot base design, Orbot handle assembly (e.g., length and mounting positions from the wheel axle to where the arms pivot the base located on the sides of the motor etc.). The folding hinge design on the handle assembly also plays an important role in terms of vibration control. The resulting disclosed configuration provides for a smooth, comfortable experience to a user.

Figure 3:
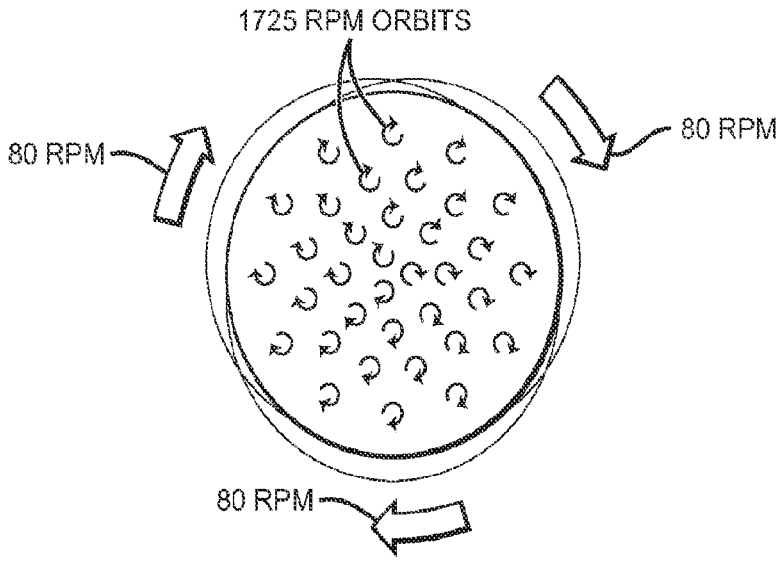
FIG. 3 illustrates a pattern of rotation and oscillations resulting from the disclose configuration of an orbital drive assembly.

The distribution of weights 233 and configuration of bearing assembly 240 provides for desired rotational and oscillatory motion. With a one horsepower motor, a rotation of 80 revolutions per minute (RPM) can be achieved while also inducing a 1,725 RRM oscillations having a ½ inch diameter. FIG. 3 illustrates one desirable oscillation pattern.

Figure 4A:
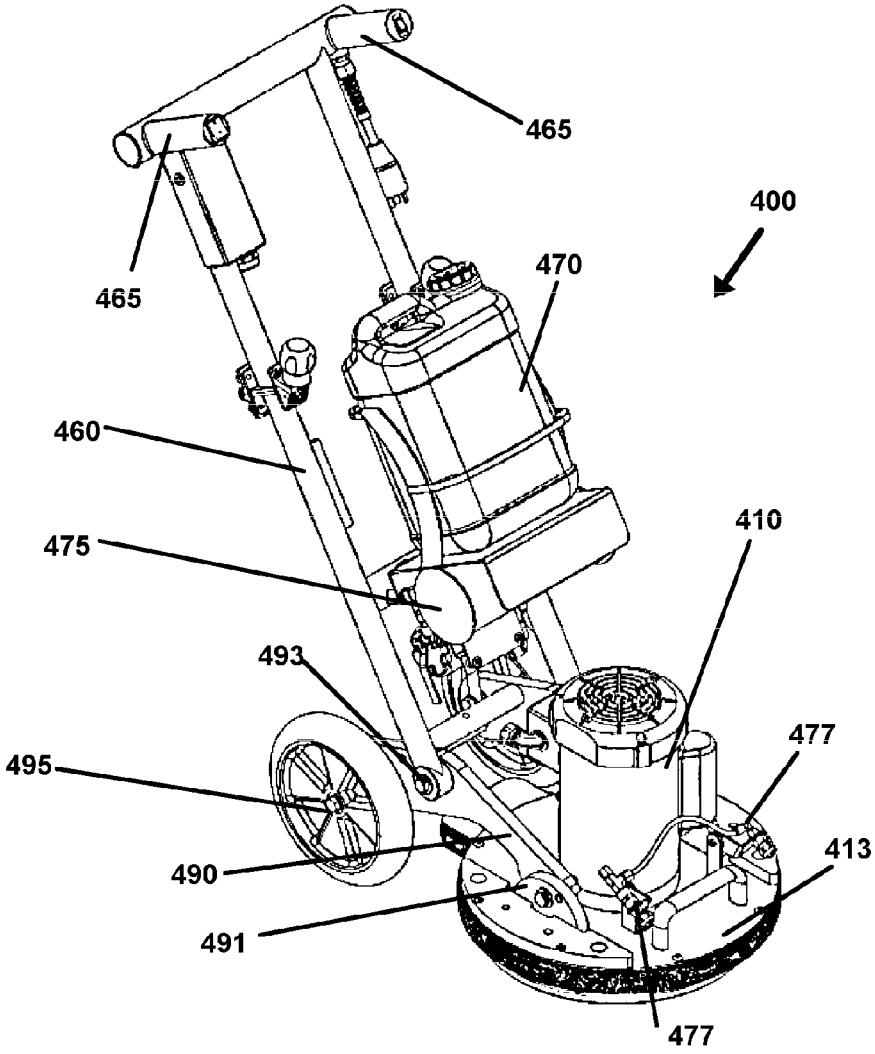
FIG. 4A illustrates features of one possible embodiment of an orbital floor cleaning apparatus.

FIG. 4A illustrates a possible embodiment of a modular surface cleaning apparatus 400, which can comprise handle assembly 460, circular driver base 413, and removable driver motor 410 coupled to circular driver base 413. Handle assembly 460 preferably comprises one or more vertical grips 465 by which a user can control or move apparatus 400. Note that vertical grips 465 are orthogonal (e.g., vertical) to a plane defined by the main struts of handle assembly 460 as opposed to laying within the same plane as in traditional approaches. Handle assembly 460 preferably pivotally couples to driver base 413 via lever arm 490. Pivotally coupling base 413 at one end of arm 490 allows base 413 to rotate into a cleaning position or a maintenance position.

Apparatus 400 can also include a replaceable bottle cartridge system 470 that allows users to quickly and easily swap out pre-mixed fluids. Additionally, apparatus 400 can include one or more removable sprayers 477 mounted to base 413 where the fluids are provided from the bottles via pump 475, located beneath cartridge system 470 between struts of handle assembly 460.

Lever arm 490 preferably comprises elbow 493 where handle assembly 460 pivotally couples to the arm. At a first end, based 413 can also pivotally couple to arm 490 via coupling ear 491. Lever arm 490 also has a second end where axel 495 couples to arm 490.

Apparatus employing the disclosed features can be obtained from Hruby Orbital Systems (http://www.hos-usa-.com) of Ontario, Calif.

Figure 4B:
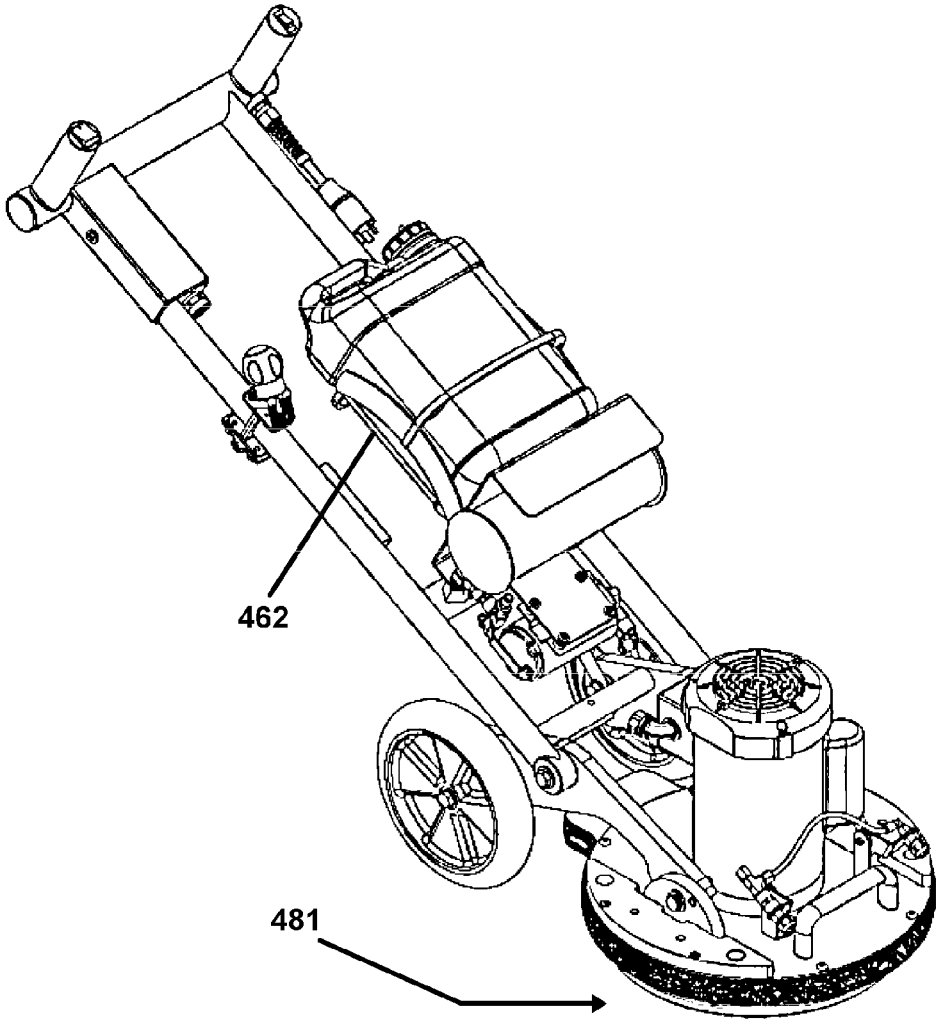
FIG. 4B illustrates the apparatus of FIG. 4A in a horizontal cleaning position.

FIG. 4B illustrates floor cleaning apparatus 400 in operating cleaning position 481. Handle assembly 460 pivots on an elbow of lever arm 490. Driver base 413 is pivotally coupled to an end of lever arm 490 allowing base 413 to operate in horizontal cleaning position 481 while handle assembly 460 can change positions freely.

Handle assembly 460 can also include locking lever 462, which can be disposed between the handle struts. Locking lever 462 allows a user to position handle assembly 460 into a desired working angle relative to a cleaning surface. Lever 462 preferably operates as a pull latch the catches on a sliding rod, which in turn holds handle assembly 460 into a set position.

Figure 4C:
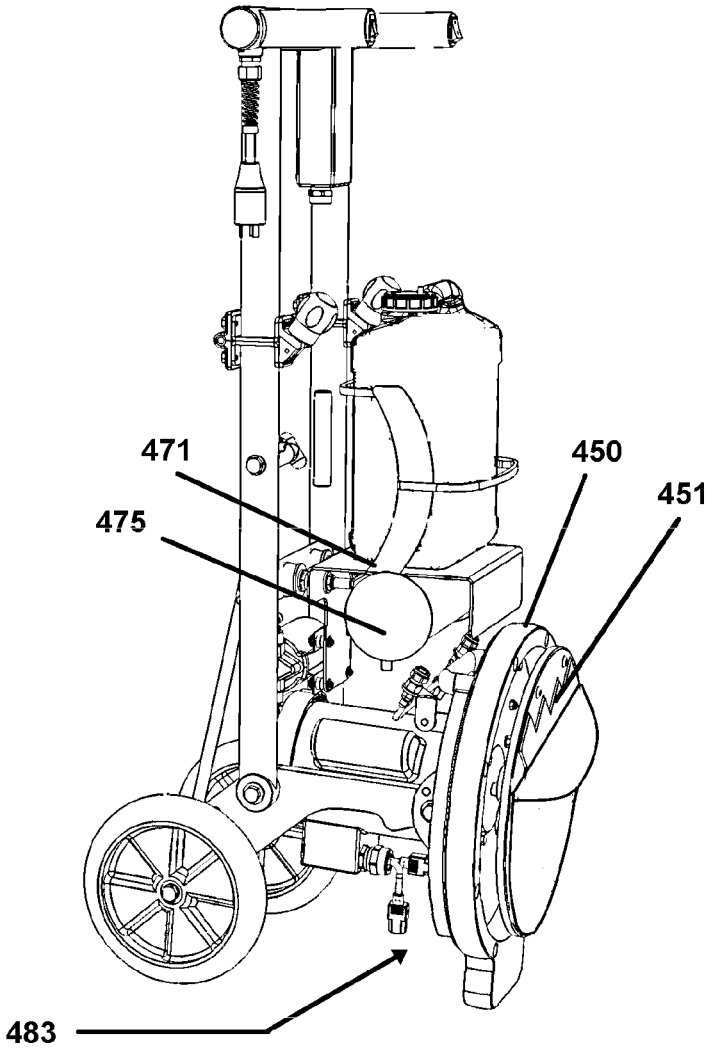
FIG. 4C illustrates the apparatus of FIG. 4A in a vertical maintenance position.

FIG. 4C illustrates floor cleaning apparatus 400 in vertical maintenance position 483. Lever arm 490 also allows driver base 413 to flip up into vertical maintenance position 483 to allow a non-technical user to replace pads. As shown, in some embodiments, driver base 413 can include driver 450 having a hook-and-loop pad fastener 451. Pad fastener 451 holds cleaning pads firmly on driver 450. One should note that handle assembly 460 is able to retain its position during a maintenance operation.

FIG. 4C provides a better view of the position of pump 475. Pump 475 can be disposed below bottle cage mount 471 in between cross bars of handle assembly 460. As illustrated, bottle cage mount 471 can mount one to a cross bar of handle assembly 460. Cage mount 471 could also be mounted directly to the struts of handle assembly 460.

Figure 4D:
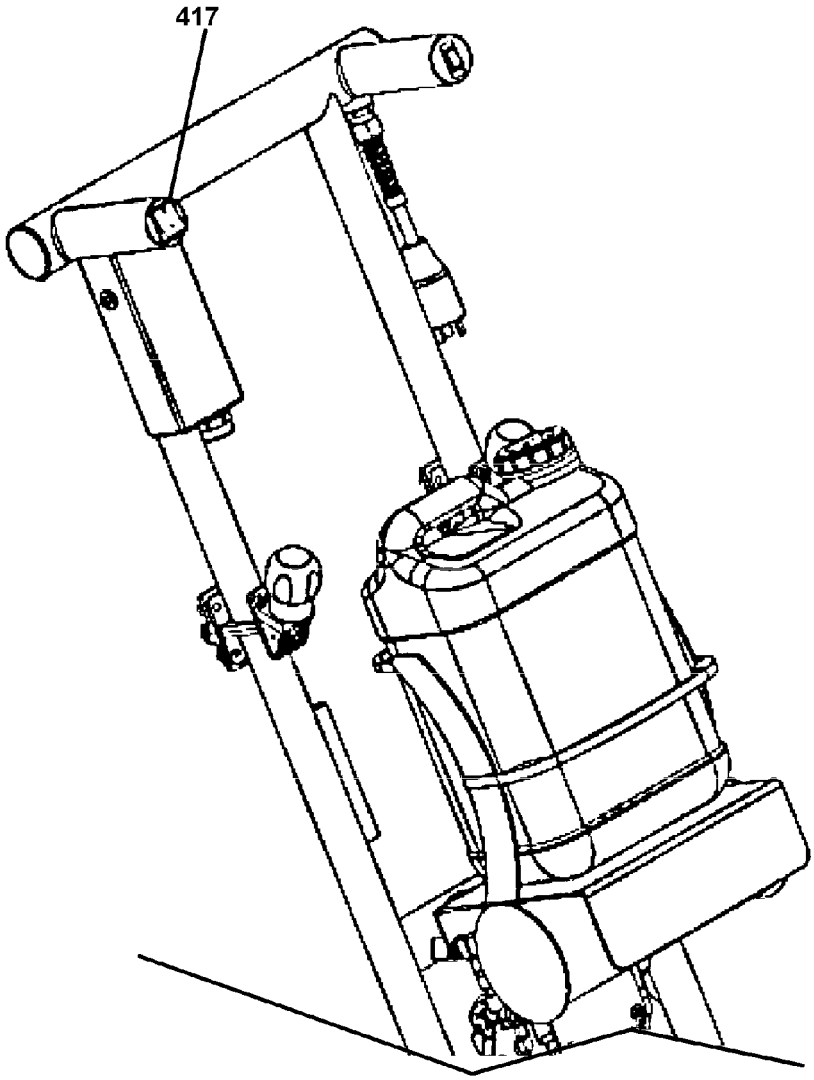
FIG. 4D illustrates the apparatus of FIG. 4A in use where a user can operate the apparatus from actuators disposed on vertical grips.

FIG. 4D presents a user's view of floor cleaning apparatus 400. A user can easily grip vertical grips 465 disposed on handle assembly 460. Vertical grips 465 provide for a more natural interaction with apparatus 400 and reduce user fatigue. Grips 465 can also include one or more of actuators 417 to control apparatus. For example, actuators 417 can toggle power to driver motor 410, operate pump 475 to spray liquid from a bottle disposed in cartridge system 470, adjust oscillation rate, or other operating parameters of apparatus 400.

Figure 4E:
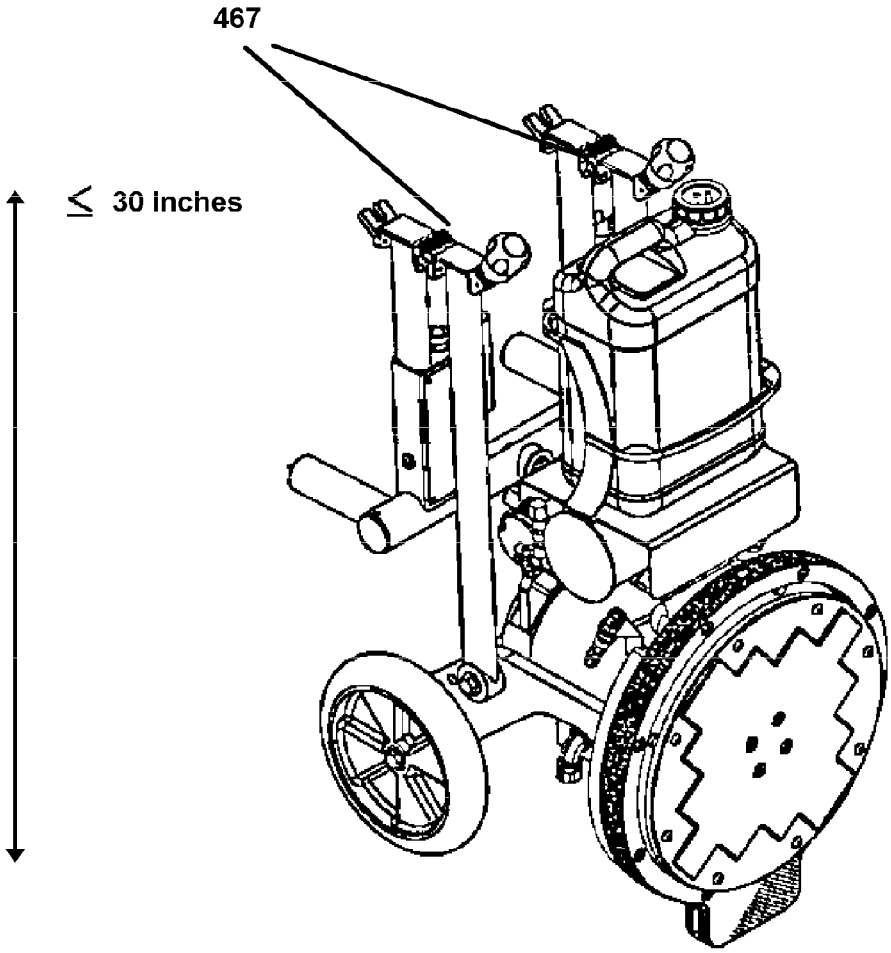
FIG. 4E illustrates the apparatus of FIG. 4A where the handle assembly has been folded down for transport.

FIG. 4E illustrates the collapsible nature of apparatus 400. In the example shown, handle assembly 460 includes a hinged connector 467 allowing a portion of handle assembly 460 to fold back against itself through an angle of about 180 degrees. Thus, apparatus 400 can be folded down in a manner where its maximum dimension is no more than 30 inches (76.2 centimeters).

One should note that the various elements of the disclosed system (e.g., pump, bottle cartridge, motor, spray nozzles, pads, driver plates, etc.) can be field replaceable by non-technical users.

Contemplated surface cleaning apparatus can include one or more of the following features:

The apparatus can transform from a non-spraying unit to a spraying unit. A spray system can be attached to or removed from the apparatus through a mounting system comprising of a small number of mechanical fasteners.

The bottle cartridge system allows for the changing of premixed solution bottles quickly thus eliminating spills and reduces overall weight of apparatus for lifting and storage.

Contemplated spray systems allow for creating an equal flow pattern that can be applied directly to a floor area. Such an approach reduces solution streaks that cause uneven dry patterns.

The spray system can also include a flow control system that controls the flow rate. Flow settings can range from off, to a dribble, or up to 1 gallon per minute.

The system can fold down to 30" in height which makes the apparatus easy to transport and store.

The driver base can flip up for quick and easy pad changing.

The apparatus can support different drivers. For example, a 17 inch apparatus can quickly and easily be converted to a 19 inch and 21 inch apparatus, and vice versa —a 21 inch version can be converted to a 17 inch or 19 inch apparatus. One apparatus fits all driver options.

Contemplated apparatus can include large wheels (e.g., 10 inch diameter) wheels for overcoming any type of staircase, steps, curbs, holes, and or other obstacles in its path.

The apparatus can be manufactured with a weight of less than 85 lbs.

The vertical handle grips provide for easy operation and lower back stress relief.

A one horsepower universal 110V/60 Hz.-220V/50 Hz. motor can be configured to operate as the driver motor to deliver over 1700 oscillations per minute.

An electrical cord can be included that can be easily removed.

It is also contemplated that the disclosed apparatus can utilize one or more gliders to ease cleaning shag carpet or other types of flooring.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

The invention claimed is:

1. An orbital floor cleaning apparatus comprising:

a handle assembly coupled to a driver base; and an orbital drive assembly coupled to the driver base, the orbital drive assembly comprising:

a driver motor disposed on an upper surface of the driver base having a drive shaft through the driver base;

a driver plate disposed under the driver base and mechanically coupled to the drive shaft, where the driver plate includes at least one offset weight;

a bearing assembly disposed under the driver plate and mechanically coupled to the drive shaft, where the bearing assembly includes a housing, a bearing, a bearing center, and a bearing retainer;

wherein said bearing center is installed within an inner diameter of said bearing;

said bearing assembly offset a vertical distance from said driver plate by at least one washer;

wherein said at least one washer, said housing, said bearing, said bearing center and said bearing retainer each have a through hole for said drive shaft to pass through, said through hole of each of said at least one washer, said housing, said bearing, said bearing center and said bearing retainer each being centered horizontally between an outer diameter of each of said at least one washer, said housing, said bearing, said bearing center and said bearing retainer when viewed from the side, and said through hole of said at least one washer, said housing, said bearing, said bearing center and said bearing retainer each being centered radially about an outer circumference of said at least one washer, said housing, said bearing, said bearing center and said bearing retainer when viewed from above and below; and a driver disposed under the bearing assembly and mechanically coupled to the bearing housing.

2. The apparatus of claim 1, further comprising a shaft support disposed between the driver base and the driver plate, said shaft support comprising a horizontal base with a through hole attached to a vertically-oriented cylindrical portion.

3. The apparatus of claim 2, wherein said at least one offset weight further comprises at least two offset weights.

4. The system of claim 3, wherein the at least two offset weights consists of two offset weights, wherein said two offset weights are attached to a bottom surface of said driver plate, wherein a second weight of said two offset weights has a different weight than a first weight of said two offset weights, said second weight is attached to said bottom surface of said driver plate at a distance from a center of rotation of said driver plate which is different than a distance from said center of rotation of said driver plate to where said first weight is attached to said bottom surface of said driver plate.

5. The apparatus of claim 2, wherein the driver plate comprises adjustable weight positions.

6. The apparatus of claim 1, wherein the driver plate is configured to couple to the at least one offset weight on at least one of a top surface and a bottom surface of the driver plate.

7. The apparatus of claim 1, wherein the driver plate is field replaceable.

8. The apparatus of claim 1, wherein the motor and said at least one weight is configured to provide a rotation of about 80 RPM and at least 1700 oscillations per minute of the driver.

9. The apparatus of claim 1, further comprising a replaceable bottle cartridge assembly disposed on and above the handle assembly and configured to hold a replaceable bottle and a pump mounted directly below said bottle cartridge assembly.

10. The apparatus of claim 9, wherein a detachable spray assembly is configured to mount to the driver base and configured to be in liquid communication with the bottle.

11. The apparatus of claim 1, wherein the driver comprises a hook-and-loop pad fastener.

12. The system of claim 1, wherein at least a portion of the handle assembly is collapsible to a collapsed position, wherein the handle assembly includes a left and right upper rod and a left and right lower rod, wherein the left and right upper rod and left and right lower rod are connected by a hinge connector, wherein a longitudinal axis through each of the left and right upper and left and right lower rods does not intersect with the handle assembly in the collapsed position, wherein the left and right upper rod and left and right lower rod are parallel with the handle assembly in the collapsed position.

13. The system of claim 12, wherein the handle assembly comprises diagonally-oriented grips, the diagonally-oriented grips extending upward from each of said left and right upper rods.

14. The system of claim 13, wherein at least one of the grips comprises an actuator, said actuator comprising a button, said button located at an end of said at least one of the grips distal from at least one of said left and right upper rods, said button capable of moving, the movement of the button being parallel to a longitudinal axis of said at least one of said grips.

15. The system of claim 14, further comprising:

wherein the motor and said at least one weight is configured to provide at least 1700 oscillations per minute;

wherein said actuator is capable of the following:

(a) toggling power to said motor;

(b) operate a pump to spray liquid from a bottle; and (c) to adjust the oscillation rate of at least 1700 oscillations per minute.

16. The system of claim 1, wherein the handle assembly is directly pivotally attached to one end of a lever arm, said lever arm is directly pivotally attached at an opposite end to an ear, said ear is fixedly attached to the driver base.

17. The system of claim 16, wherein said pivotal attachment of said lever arm to said ear allows the driver base to rotate from a horizontal cleaning position to a vertical maintenance position.

18. The system of claim 16, wherein the handle assembly folds down to have a maximum dimension of no more than 30 inches which is equal to 76.2 centimeters.

19. An orbital floor cleaning apparatus comprising:

a handle assembly coupled to a driver base; and an orbital drive assembly coupled to the driver base, the orbital drive assembly comprising:

a driver motor disposed on an upper surface of the driver base having a drive shaft through the driver base;

a driver plate disposed under the driver base and mechanically coupled to the drive shaft, where the driver plate includes at least one offset weight;

a bearing assembly disposed under the driver plate and mechanically coupled to the drive shaft, where the bearing assembly includes a housing, a bearing, a bearing center, and a bearing retainer;

wherein said bearing center is installed within an inner diameter of said bearing;

said bearing assembly offset a vertical distance from said driver plate by at least one washer;

a driver disposed under the bearing assembly and mechanically coupled to the bearing housing; and a shaft support disposed between the driver base and the driver plate, said shaft support comprising a horizontal base with a through hole attached to a vertically-oriented cylindrical portion.

20. An orbital floor cleaning apparatus comprising:

a handle assembly coupled to a driver base;

wherein the handle assembly is directly pivotally attached to one end of a lever arm, said lever arm is directly pivotally attached at an opposite end to an ear, said ear is fixedly attached to the driver base;

wherein at least a portion of the handle assembly is collapsible to a collapsed position, wherein the handle assembly includes a left and right upper rod and a left and right lower rod, wherein the left and right upper rod and left and right lower rod are connected by a hinge connector, wherein a longitudinal axis through each of the left and right upper and left and right lower rods does not intersect with the handle assembly in the collapsed position, wherein the left and right upper rod and left and right lower rod are parallel with the handle assembly in the collapsed position;

an orbital drive assembly coupled to the driver base, the orbital drive assembly comprising:

a driver motor disposed on an upper surface of the driver base having a drive shaft through the driver base;

a driver plate disposed under the driver base and mechanically coupled to the drive shaft, where the driver plate includes at least one offset weight;

a bearing assembly disposed under the driver plate and mechanically coupled to the drive shaft, where the bearing assembly includes a housing, a bearing, a bearing center, and a bearing retainer;

wherein said bearing center is installed within an inner diameter of said bearing;

said bearing assembly offset a vertical distance from said driver plate by at least one washer; and a driver disposed under the bearing assembly and mechanically coupled to the bearing housing.

* * * * *